United States Patent [19]

Ripley

[11] 4,046,318

[45] Sept. 6, 1977

[54] AUTOMATIC BOILER DAMPER

[76] Inventor: Mervyn Ripley, 24 Canton Court, Brooklyn, N.Y. 11229

[21] Appl. No.: 659,112

[22] Filed: Feb. 18, 1976

[51] Int. Cl.[2] ..... G05D 23/00

[52] U.S. Cl. ..... 236/1 G; 110/163; 126/285 B

[58] Field of Search ..... 236/1 G, 93 R, 93 A, 236/45; 110/163; 126/285 R, 285 B

[56] References Cited

U.S. PATENT DOCUMENTS

| | | | |
|---|---|---|---|
| 1,848,653 | 3/1932 | Persons | 236/68 R |
| 2,188,865 | 6/1940 | Maynard | 236/1 G |
| 2,224,705 | 12/1940 | Stringer | 236/1 |
| 2,416,468 | 2/1947 | Carsten | 236/45 |

*Primary Examiner*—William E. Wayner
*Assistant Examiner*—Robert J. Charvat
*Attorney, Agent, or Firm*—Robert D. Farkas

[57] ABSTRACT

An automatic boiler damper comprising a solenoid valve secured to the pivot axis of a damper included within a stack utilized to vent a heating system. The solenoid is electrically operated upon the closing of a thermostat secured to the stack at a point immediately over the damper location. The damper is provided with a vent hole which enables the thermostat to detect the presence of heated stack gases in sufficient quantity and temperature flowing upwardly from the damper in the closed position, so as to enable the solenoid to open the damper and vent the stack gases through the stack. Heat is conserved thereby and cold drafts are not permitted to enter the stack as a downdraft.

1 Claim, 3 Drawing Figures

AUTOMATIC BOILER DAMPER

BACKGROUND OF THE INVENTION

1. The Field of the Invention

This invention relates to damper control devices and more particularly to that class adapted to automatically operate the damper into an open position when the stack temperature exceeds a pre-determined level at a location immediately above the location of the damper.

2. Description of the Prior Art

The prior art abounds with mechanisms designed to control the positioning of vane type dampers mounted within a stack, used in combination with heating systems of diverse types, U.S. Pat. No. 2,179,120, issued to W. E. Firehammer on Nov. 7, 1939 teaches a solenoid operated damper which is actuated when the thermostat controlling the combustion cycling period of the heating system, calls for more heat. The damper is automatically closed when the heating system has elevated the ambient temperature surrounding the thermostat to the desired temperature, which in turn, causes the furnace to stop operating. U.S. Pat. No. 2,224,705, issued to G. E. Stringer, on Sept. 10, 1940, discloses a solenoid actuated vane type damper installed within the flue of a boiler which is operated into the open position when the ignition system of the boiler is energized. The damper is closed upon the de-energization of the ignition system. U.S. Pat. No. 2,344,925, issued to G. Den Besten Et Al on Feb. 9, 1944 illustrates a solenoid controlled vane type damper installed into the stack of a boiler which is operated into the open position when the flue pressure exceeds a pre-determined level and closes automatically when the flue pressure falls below another pre-determined level.

All of the aforementioned patents provide diverse means controlling the vane type damper other than sensing the temperature at a point immediately above the damper so as to conserve the energy stored in the stack during periods that the stack gasses are at a low temperature.

SUMMARY OF THE INVENTION

A primary object of the instant invention is to provide a vane type damper control unit operating the damper into an open position at a point in time when the stack temperature exceeds a pre-determined level.

Another object of the instant invention is to vent the stack only upon an absolute need therefore, conserving the amount of heat energy retained within the stack at all other times.

Still another object of the instant invention is to preclude the admission of reverse cold air drafts down the flue during periods of time that the damper is closed, thereby conserving fuel.

Yet another object of the instant invention is to provide a damper control which is economical to construct adapted with a minimum number of operating parts.

A further object of the instant invention is to provide a damper control which can be adapted to mount to existing dampers requiring a minimal effort therefor.

Another object of the instant invention is to provide a mechanism that will open and close the damper, elimiminating rattling of the damper vane.

Vane type dampers are usually equipped with a pivotable axis extending through the side walls of circular flues. The vane, to be utilized with the instant invention, is equipt with a small vent hole, located in the lateral surface thereof, enabling a small amount of stack gas to escape therethrough. A thermostat is installed on the exterior surface of the flue, having a temperature sensing element extending radially inwardly, directly over the vent hole aforementioned. A solenoid coil is provided, which has a core linked to the pivot shaft of the damper. When the solenoid is energized the damper is moved into a vertical plane permitting the hat stack gasses, trapped beneath the damper, to escape up the flue. The thermostat, upon detection of stack gasses having a sufficiently high temperature, escaping through the damper vent opening, closes its operating contacts so as to energize the solenoid coil. A pair of spiral wound springs maintain the damper in the closed position when the solenoid coil is not energized, eliminating thereby, rattling of the vane otherwise obtained. The springs and the solenoid coil including the linkage arm affixed to the shaft of the damper, are adapted to be enclosed within a pair of housings designed to be fastened to the external surface of the flue, concealing the ends of the damper pivot axis therewithin. The series conduit comprising the contact switch assembly of the thermostat and the solenoid coil is connected to a suitable source of operating voltage. If desired, the voltage source utilized to supply operating voltage to the series circuit may be selected to cycle in unison with the fuel solenoid valve, thereby shortening the time period that the damper remains in the open position.

These objects, as well as other objects, of this invention will become readily apparent after reading the following description of the accompanying drawings.

DESCRIPTION OF THE PREFERRED EMBODIMENT

The structure and method of fabrication of the present invention is applicable to a heating system damper, of the vane variety, installed within a circular flue. The damper is provided with a pivot axis extending through the walls of the flue and a small small vent hole in the lateral surface of the damper vane. Each end of the pivot axel is adapted with a helical spring, wound in spiral shape, which maintains the vane in a closed position when otherwise not operated into an open position. The damper may be opened upon the actuation of an electrically operated solenoid coil, which has a core pivotably linked to one end of the pivot axel.

A thermostat assembly is secured to the exterior surface of the stack and is adapted to have the temperature sensing element thereof extending radially inwardly so as to measure the temperature of the stack gasses escaping through a vent hole in the damper vane. When the temperature of the stack gasses escaping through the vent hole reaches a pre-determined level, and is capable to operate the thermostat assembly so as to have the contacts associated therewith close, enabling the solenoid coil to become energized. The vane is then openend and will continue to remain open for a period of time in which the gasses escaping up the flue continue to maintain the temperature sensing element of the thermostat above a preset minimum. Upon falling below a preset minimum, the thermostat switch contacts open, closing the damper, precluding thereby, further escape of heated gasses and the prevention of cold air downdrafts.

The location of the temperature sensing element determines when the damper is operated into an open position, occurring when a small quantity of heated gas raises the temperature of the sensing element to a desired level. Alternatively, the temperature sensing element senses gas escaping through the open vented vane, providing thereby assurance that the stack will remain open for a sufficient period of time to vent noxious fumes. Thus the damper tends to open reluctantly on a temperature build-up and to remain open willingly thereafter insuring adequate venting following each system heating cycle.

Figure 1:
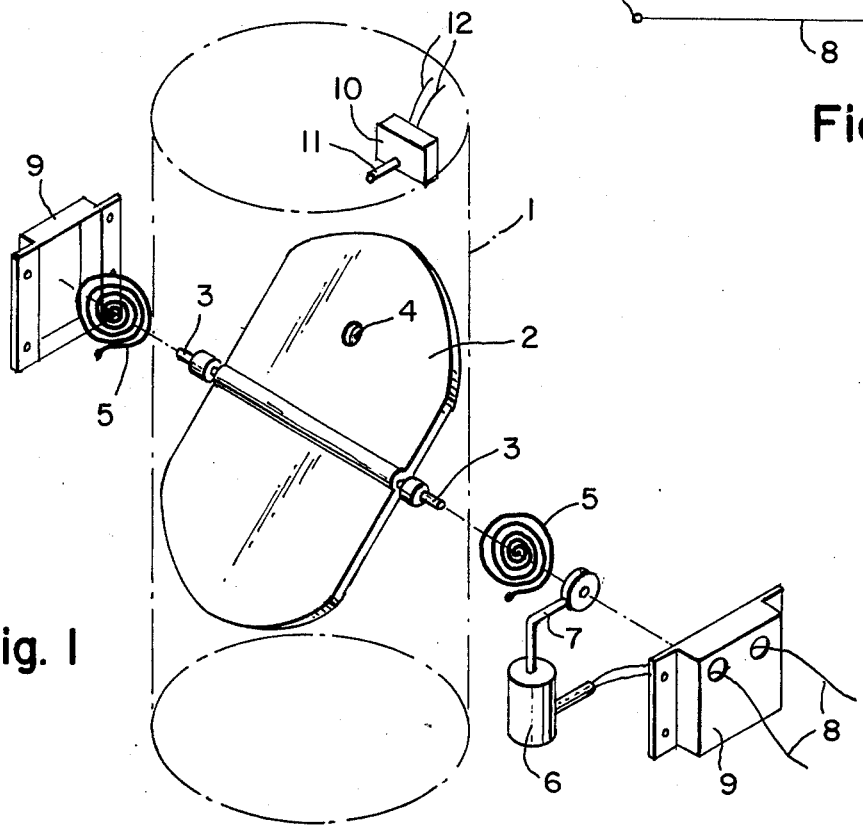
FIG. 1 is a perspective view of the elements of the automatic boiler damper, shown in exploded form.

Now referring to the figure and more particularly to the embodiment illustrated in FIG. 1 showing a circular stact 1 having a vane type damper 2 therein. Axel 3 pivotably secures the vane to the walls of the flue. The vane is provided with a vent hole 4 permitting the escape of gas rising up the flue when the damper is in a closed, near horizontal position. Spirally wound springs 5 are adapted to engage axel 3, maintaining the vane in a closed position. Electrical solenoid coil 6 has a linkage arm 7 adapted to engage one end of axel 3, such that, when solenoid 6 is energized, by providing electrical energizing power to wires 8, linkage arm 7 is drawn into the solenoid coil, causing the pivot axel to rotate, thus opening the vane element. Covers 9 are provided to enclose springs 5 and solenoid 6 including linkage arm 7. A thermostat assembly 10 is fastened to the exterior surface of stack 1 and is adapted with sensing element 11 extending inwardly over the vent hole 4. When the sensing element 11 reaches a pre-determined temperature, the contacts connected to wires 12 are closed and are utilized to connect the solenoid wires 8 to a convienient source of energizing power. Vane 2 will close upon sensing element 11 reverting to the pre-determined minimal level, opening the contacts connected to wire 12 thereby.

Figure 2:
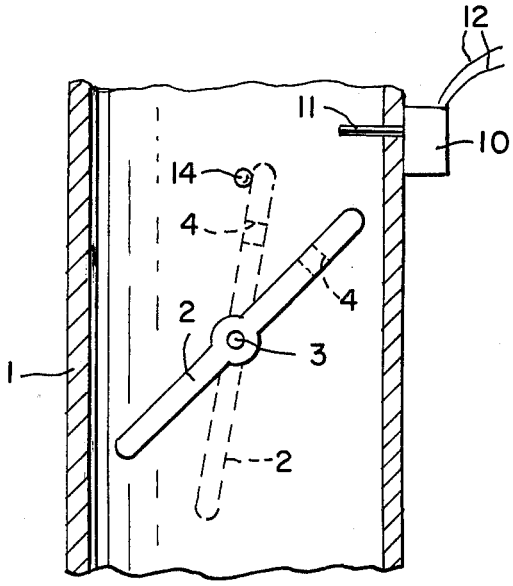
FIG. 2 is a side elevation view of a portion of the flue and damper illustrated in FIG. 1.

FIG. 2 shows the stack 1 in a cross-sectional view and the damper vane 2 at a forty-five degree angle to the longitudinal axis of the stack. Vent hole 4 is shown in the surface of the vane, positioned directly below sensing element 11 affixed to thermostat assembly 10. The thermostat assembly is secured to the outside surface of the stack assembly 1 and is provided with wires 12 connected to the contacts of the thermostat assembly, not shown. The vane 2 is illustrated in the phantom mode when pivoted about axel 3 into the near vertical position and in touching engagement with a vane stop element 14, limiting the rotational displacement thereby.

Figure 3:
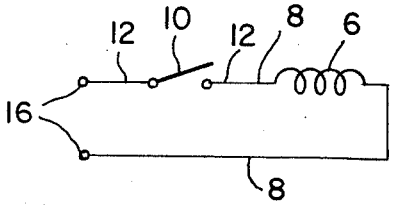
FIG. 3 is a schematic representation of the electrical elements utilized to control the position of the damper vane.

FIG. 3 is a schematic representation of the switch element of thermostat 10 connected to wires 12 shown in series connection with solenoid coil 6 having wires 8 extending from the terminals thereof. A suitabale source of energizing voltage is connected to terminals 16.

One of the advantages is a vane type damper control unit operating the damper into an open position at a point in time when the stack temperature exceeds a pre-determined level.

Another advantage is to vent the stack only upon an absolute need therefore, concerving the amount of heat energy retained within the stack at all other times.

Still another advantage is to preclude the admission of damp cold air reverse drafts down the flue during periods of time that the damper is closed, thereby concerving fuel.

Yet another advantage is a damper control which is economical to construct adapted with a minimum number of operating parts.

A further advantage is a damper control which can be adapted to mount to existing dampers requiring a minimum effort therefor.

Another advantage is a mechanism that will open and close the damper, eliminating rattling of the damper vane.

Thus, there is disclosed in the above description and in the drawings, an embodiment of the invention which fully and effectively accomplishes the objects thereof. However, it will become apparent to those skilled in the art, how to make variations and modifications to the instant invention. Therefore, this invention is to be limited not by the specific disclosure herein, but only by the appending claims.

I claim:

1. The combination of a heating system, a stack venting said heating system, a vane-type damper pivotably secured to said stack about an axle passing through the surfaces of said stack, the improvement comprising an automatic boiler damper having an electrically operated solenoid coil adapted to manipulate said vane into an open position, venting means adapted to permit a small amount of stack gases to emerge through said vane when said vane is in a closed position, temperature sensing means, said temperature sensing means including a temperature sensing element adapted to sense the temperature of said small amount of stack gases, said temperature sensing means adapted to supply energizing power to said solenoid coil upon reaching a predetermined temperature level thereabout, said temperature sensing means including a pair of normally open contacts, said pair of normally open contacts being disposed in electrical touching engagement to each other when the temperature of said temperature sensing element reaches a preset temperature level, said pair of normally open contacts in a series electrical circuit with said solenoid coil, said series electrical circuit provided with operating power derived from said heating system when said heating system is electrically operated to produce heat.

* * * * *